United States Patent [19]

Winheim

[11] 3,948,721

[45] Apr. 6, 1976

[54] METHOD AND APPARATUS FOR WETTING THE WEB IN PAPER MAKING MACHINES

[76] Inventor: Karl H. Winheim, Gustav-Freytag-Strasse 35, 6000 Frankfurt am Main, Germany

[22] Filed: Sept. 3, 1974

[21] Appl. No.: 502,399

[52] U.S. Cl. ..... 162/207; 162/119; 162/122

[51] Int. Cl.[2] ..... D21F 11/00

[58] Field of Search ..... 162/119, 122, 198, 207, 162/252

[56] References Cited

UNITED STATES PATENTS

| | | | |
|---|---|---|---|
| 2,951,007 | 8/1960 | Lippke | 162/198 |
| 3,467,541 | 9/1969 | Aronsson et al. | 162/207 X |

*Primary Examiner*—Arthur D. Kellogg
*Attorney, Agent, or Firm*—Michael J. Striker

[57] ABSTRACT

The moisture content of a web of newsprint paper which runs from the drying unit to the collecting station of a paper making machine is increased in several stages by atomized water issuing from rows of spraying devices followed by cylindrical members which distribute the particles of water in the material of the web. The rate of water discharge from each spraying device is adjustable so as to compensate for eventual differences between the moisture content in the marginal portions and the moisture content in the median portion of the web.

24 Claims, 7 Drawing Figures

FIG. 2
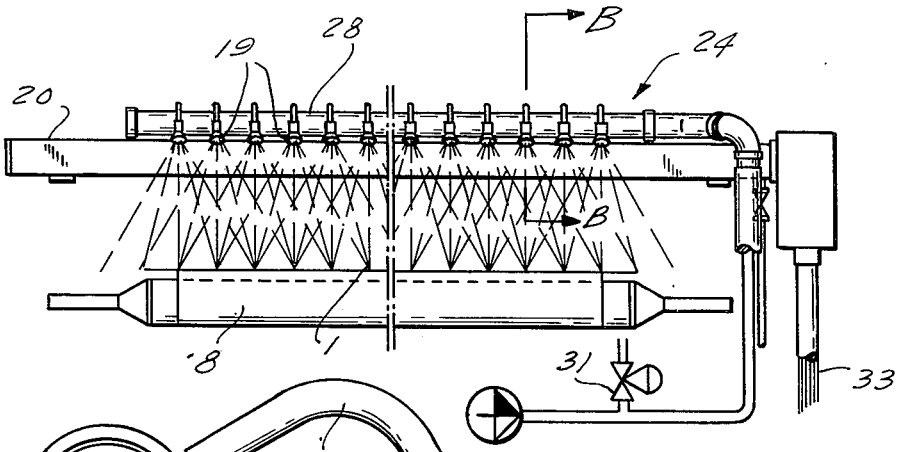
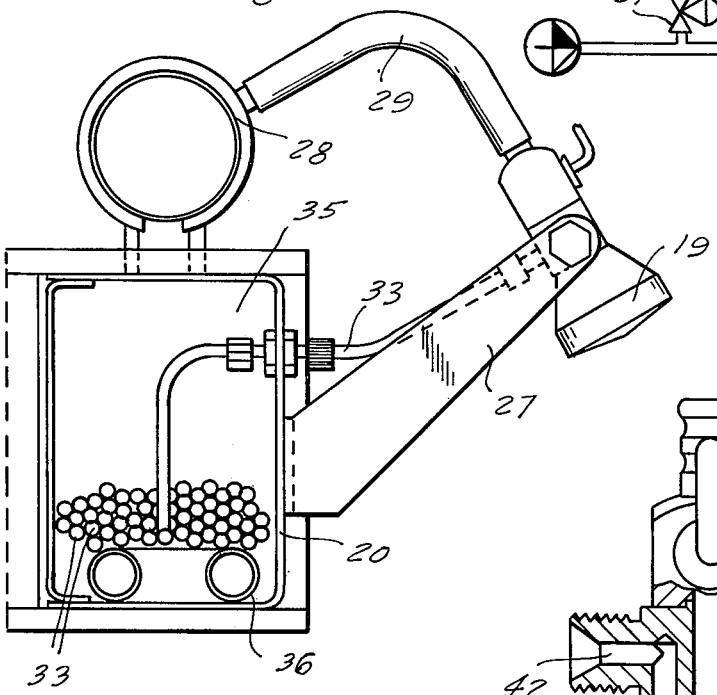
FIG. 3
FIG. 4
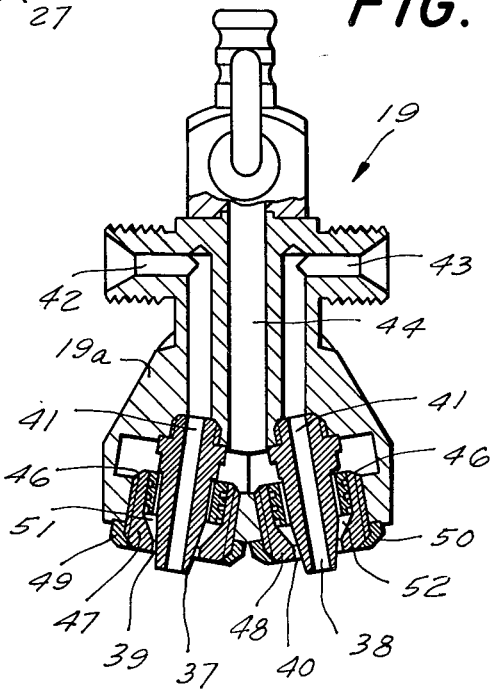

FIG. 5
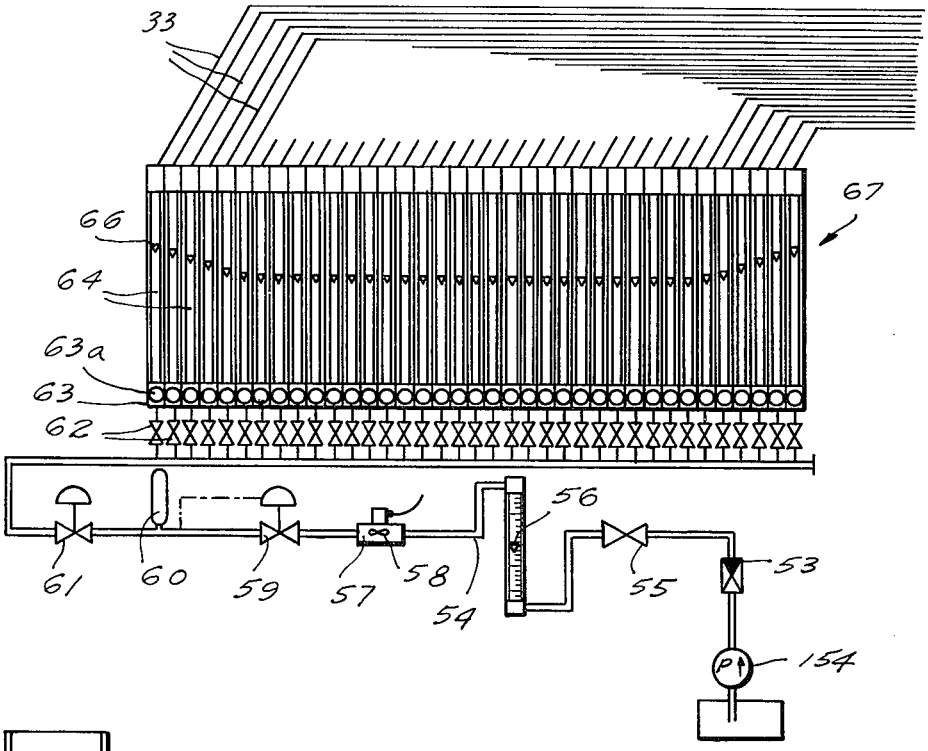
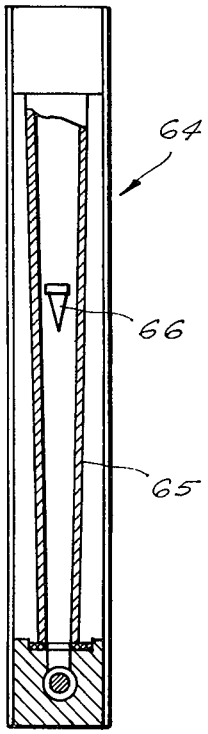
FIG. 6
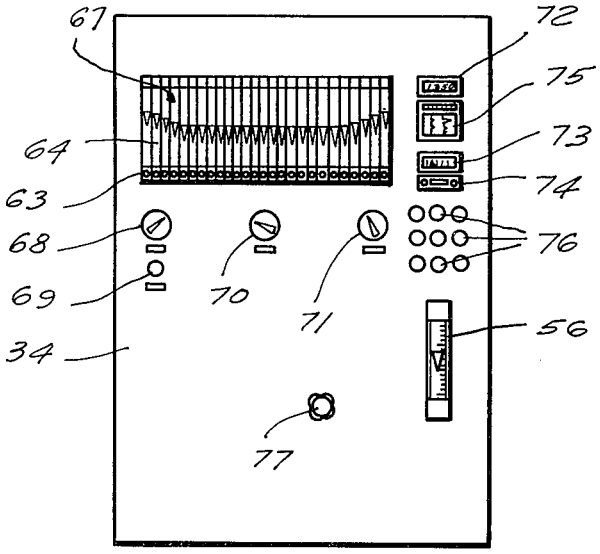
FIG. 7

METHOD AND APPARATUS FOR WETTING THE WEB IN PAPER MAKING MACHINES

BACKGROUND OF THE INVENTION

The present invention relates to paper making machines in general, and more particularly to improvements in a method and apparatus for wetting continuous sheets or webs of newsprint paper or the like in paper making machines.

It is well known to increase the moisture content of continuous paper webs in the region between the drying unit and the rolling or convoluting station of a paper making machine. The means for increasing the moisture content of the web comprises a single wetting unit which employs a series of spraying devices having means for directing finely atomized liquid onto the moving web before the web is converted into a roll. Wetting of the web is desirable because the drying unit normally reduces the moisture content below that value which is most satisfactory for storage of the web in the form of a roll and/or for further processing. Moveover, uniform drying of a rapidly moving paper web (e.g., newsprint paper) is practically impossible so that the drying action is invariably regulated in such a way that the moisture content of paper leaving the drying station is too low.

The commonly owned U.S. Pat. No. 3,332,625 to Nagler et al. discloses a turbo nozzle spray damper wherein each spraying device comprises two water discharging nozzles. The air streams which issue from the air discharging nozzles are caused to spin and to peel off thin layers from the respective water jets to thus produce sprays consisting of minute water particles which impinge upon the moving paper web. The pressure of air is extremely low, normally in the range of 0.05–0.2 atmospheres superatmospheric pressure. The rate at which the liquid is sprayed onto the web can be regulated by changing the quantity of the supply of liquid in a vessel which is connected with the water discharging nozzles by discrete conduits.

The just described spray damper operates satisfactorily as long as the moisture content of the paper web which is to be wetted does not deviate appreciably from a desired optimum moisture content, as long as the speed at which the web is transported is relatively low, and as long as the web is capable of absorbing substantial quantities of water or another liquid. It has been found that, when the web is transported at a high speed (e.g., in the range of 450–900 meters per minute or higher), and when the moisture content of the freshly dried web is well below the desired mositure content, the droplets which are discharged by the patented spray damper produce readily detectable marks which detract from the appearance of the final product. Moreover, the mositure content is not uniform in all regions of the convoluted web.

The situation is further aggravated in machines for the production of newsprint paper. In such machines, the web is transported at a very high speed (within the aforementioned range) at which the drying action of air currents is normally much more pronounced at the marginal portions than in the median portion of the web. Consequently, the web which advances toward the spray damper has a low moisture content along both edges and a much higher mositure content in the central portion thereof. The differences between the moisture content of the marginal portions and the mositure content of the median portion become more pronounced if the speed of lengthwise movement of the web is increased. For example, when a web of newsprint paper is transported at a speed of up to and in excess of 900 meters per minute, the mositure content of the median portion often exceeds the mositure content of the marginal portions by as much as 3–4 percent. This is undesirable for a number of reasons. Attempts to eliminate such pronounced differences in moisture content have met with limited success. As a rule, an equalization of moisture content with presently known wetting apparatus results in the formation of readily detectable spots which develop where the particles of liquid impinge on the web while the latter travels past the spray damper.

SUMMARY OF THE INVENTION

An object of the invention is to provide a novel and improved wetting apparatus for rapidly moving webs of newsprint paper or the like which can uniformize the moisture content of paper without affecting the appearance of the product.

Another object of the invention is to provide a wetting apparatus which can be installed in existing paper making machines as a superior substitute for or in addition to conventional spray dampers or the like.

A further object of the invention is to provide a wetting apparatus which can uniformize the mositure content of rapidly moving paper webs even if the mositure content in one or more regions of the web deviates considerably from the moisture content in the other region or regions of the same web.

An additional object of the invention is to provide a wetting apparatus which is simple, compact and adjustable to conform its wetting action to the moisture content of oncoming increments of a moving paper web, which can change the wetting action in dependency on changes in the moisture content of the moving web, and which can utilize at least some components of conventional paper making machines.

Still another object of the invention is to provide a novel and improved method of wetting rapidly moving webs of newsprint paper or the like.

The method of the present invention comprises drying a continuous web of newsprint paper or the like, transporting the dried web along a predetermined path and in a predetermined direction toward a station where the web is converted into a roll, and increasing the moisture content of the web in a plurality of stages in a plurality of different portions of the predetermined path. The method may further comprise the steps of measuring the moisture content in different strip-shaped portions of the moving web, comparing the measured moisture content with a predetermined optimum moisture content, and regulating the wetting action in at least one of the aforementioned stages in dependency on the difference between the measured and predetermined moisture content for the respective strip-shaped portion or portions of the web.

The apparatus of the present invention is utilized for wetting a continuous web of at least partially dried paper, particularly newsprint paper, which is moved in a paper making machine in a predetermined direction and along a predetermined path toward a collecting station where the web is converted into a roll. The apparatus comprises a plurality of discrete wetting units including first and second wetting units which are respectively adjacent to first and second portions of the path (the second portion is located downstream of the first portion, as considered in the direction of lengthwise movement of the web toward the collecting station). Each wetting unit includes a plurality of spraying devices which form at least one row extending substantially transversely of the respective portion of the path and each spraying device comprises means for directing at least one spray of atomized liquid (e.g., water) against one side of the moving web, and a substantially cylindrical member located downstream of the row of spraying devices and engaging the moistened side of the web to distribute the liquid in the material of the web.

At least one of the cylindrical members may constitute a preferably rotary (driven or idling) component of the paper making machine and serves to move and/or guide the web in the aforementioned path. For example, the cylindrical members of the first wetting unit may consitute a cooling cylinder.

The distribution of atomized liquid in the material of the web can be further improved if the spraying devices and the cylindrical members of the first and second wetting units are mounted at the opposite sides of the path for the paper web.

The novel features which are considered as characteristic of the invention are set forth in particular in the appended claims. The improved wetting apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is an enlarged front elevational view of a wetting unit as seen in the direction of arrow A in FIG. 1;

FIG. 3 is an enlarged schematic transverse vertical sectional view as seen in the direction of arrows from the line B—B of FIG. 2;

FIG. 4 is an enlarged partly elevational and partly sectional view of a spraying device;

FIG. 5 is a schematic view of the means for supplying liquid to the spraying devices of a wetting unit;

FIG. 6 is an enlarged vertical sectional view of an indicating device for the rate of liquid flow to a spraying device; and FIG. 7 is a schematic front elevational view of a control panel for a wetting unit.

DESCRIPTION OF THE PREFERRED EMBODIMENTS

Figure 1:
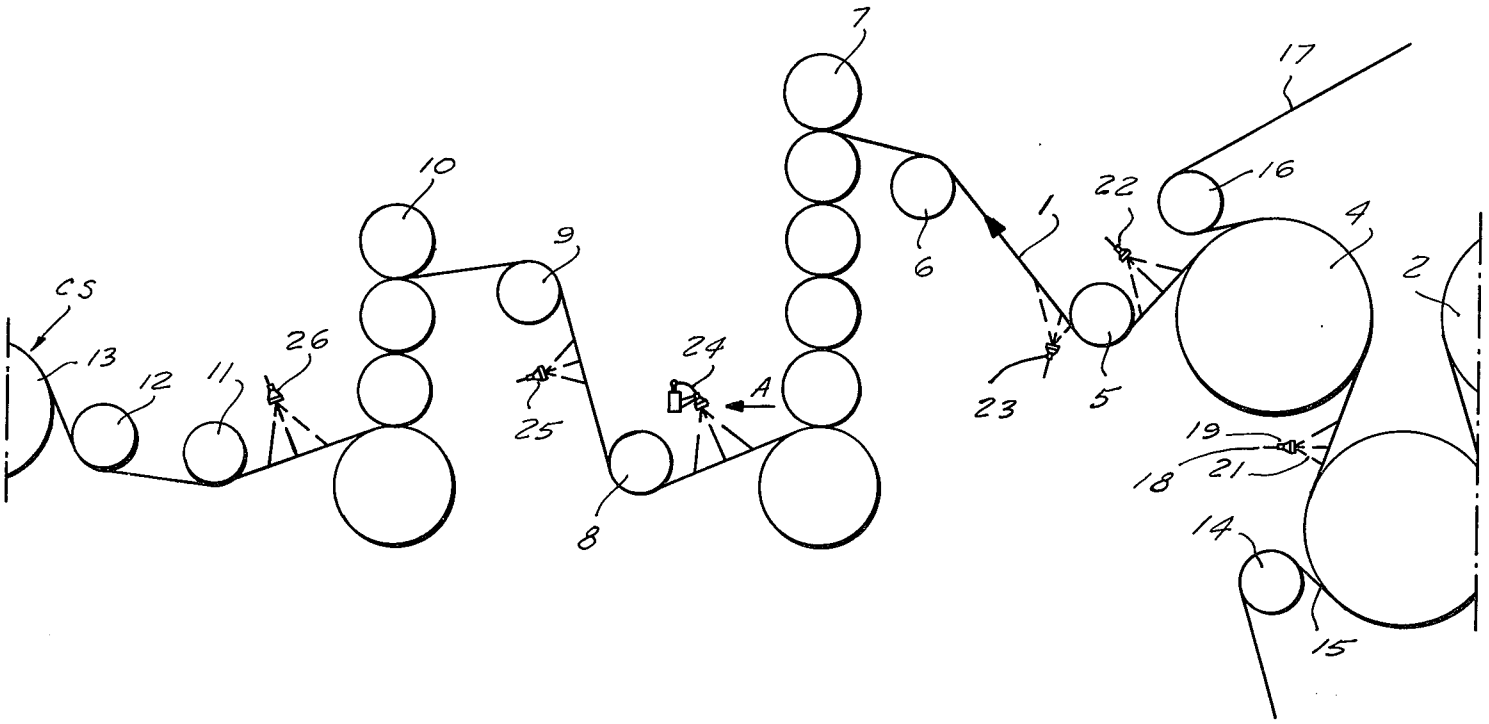
FIG. 1 is a schematic elevational view of a portion of a paper making machine and a wetting apparatus which embodies the invention.

FIG. 1 shows a portion of a paper making machine wherein a continuous web 1 of newsprint paper is transported in a direction from the right to the left along a predetermined path defined by a plurality of rotary cylindrical members and on to a collecting station CS where the web is converted into a roll 13. The main portion of the web drying station is located to the right of FIG. 1. The web 1 passes around a cylindrical member or drying roller 2, thereupon around a cylindrical member or drying roller 3, and past the first (18) of several wetting units which are adjacent to different portions of the path between the drying station and the collecting station CS. The wetting unit 18 comprises a row of spraying devices 19 (see also FIGS. 2 and 3) which discharge sprays 21 of atomized liquid (e.g., water) against the left-hand side of the paper web 1, and a cylindrical member 4 which is located downstream of the spraying devices 19 and engages the same side of the web 1 so as to distribute the liquid in the material of the web. The cylindrical member 4 of the first wetting unit 18 constitutes the cooling cylinder of the paper making machine.

During travel around the drying roller 3, the web 1 is surrounded by a felt layer 15 which is trained over and led away by a guide roller 14. A second felt layer 17 surrounds the web 1 during travel around the cooling cylinder 4 and is trained over a guide roller 16 so that it leaves the path for the web 1 before the web reaches and moves past a second wetting unit 22. The layer 17 is located at the outer side of the web 1 during travel around the roller 2 and at the inner side of the web during travel around the roller 3.

The wetting unit 22 is similar to or identical with the wetting unit 18, i.e., it also comprises spraying devices 19 forming a row which extends transversely of the respective portion of the path for the web 1, and a cylindrical member 5 which engages the web downstream of the spraying devices of the wetting unit 22. The cylindrical member 5 constitutes a driven guide roller of the paper making machine.

It will be noted that the wetting units 18 and 22 are disposed at the opposite sides of the path for the web 1, i.e., the sprays 21 issuing from the devices 19 of the unit 18 impinge on that side of the web 1 which was in contact with the felt layer 15, and the sprays issuing from the devices 19 of the unit 22 impinge upon the other side of the web 1 (which was in contact with the felt layer 17).

The roller 5 is immediately followed by a third wetting unit 23 having a row of spraying devices 19 and a cylindrical member 6. The latter constitutes a second guide roller of the paper making machine.

The web which advances beyond the guide roller 6 enters a first calendering unit 7 and thereupon advances past a fourth wetting unit 24 having a row of spraying devices 19 and a cylindrical member 8 constituting a third guide roller of the paper making machine. The wetting unit 24 is followed by a fifth wetting unit 25 having a row of spraying devices 19 and a cylindrical member 9 which constitutes a fourth guide roller of the machine. The web thereupon passes through a second calendering unit 10 which is followed by a sixth wetting unit 26 having a row of spraying devices 19 and a cylindrical member 11 constituting a fifth guide roller of the paper making machine. The roller 11 is followed by a further guide roller 12 located immediately upstream of the collecting station CS. The web which forms the roll 13 can be collected on a conventional Pope roller.

The web 1 is assumed to consist of wood pulp and is transported at a speed of 450–900 meters per minute.

The number of wetting units can be reduced to less than six (e.g., to two) or increased beyond six, depending on the speed and nature of material of the web as well as on the difference between the moisture content of successive increments of the web issuing from the drying station and the desired mositure content of the web at the collecting station CS. It has been found that, by utilizing only two wetting units (e.g., the units 18 and 22 which apply moisture to different sides of the web), the moisutre content of the web can be substantially increased without affecting the appearance of the finished product which forms the roll 13. As a rule, the improved apparatus will comprise as many as six wetting units only in certain specific cases; in most instances, the moisture content of the web can be increased satisfactorily by restoring to two, three or four wetting units which can be installed anywhere between the drying and collecting stations. It has been found that the moisture content of the material of roll 13 is more uniform if the wetting units are installed immediately downstream of the drying station (see the units 18, 22 and 23 of FIG. 1) so that the moisturized web must cover a substantial distance during travel from from the last wetting unit to the collecting station: this insures a more satisfactory distribution of moisture in all portions of the web prior to coiling, even if the web is transported at an extremely high speed.

The purpose of the cylindrical members (4, 5, 6, 8, 9, 11) of the wetting units 18, 22, 23, 24, 25, 26 is to insure a desirable distribution of liquid in the material of the web before the thus treated portion of the web reaches the next wetting unit or the collecting station CS. Certain cylindrical members (e.g., the members 6 and 11) engage and deflect relatively short portions of the web, and certain other cylindrical members (e.g., 4,5) engage and deflect much longer portions of the web. The extent of contact between a cylindrical member and the web depends on the function of the cylindrical member in the paper making machine (for example, the cooling cylinder 4 will engage the web to the extent which is needed to reduce the temperature of the web to a desired value) if the cylindrical member performs several functions and/or on the quantity of liquid which is being discharged by the spraying devices 19 of the respective wetting unit.

A wetting apparatus which comprises several discrete wetting units exhibits a number of important advantages. It has been found that a rapidly moving paper web is incapable of quickly absorbing large quantities of a liquid. Thus, if all of the liquid which is needed to increase the mositure content of a web of newsprint paper between the drying unit and the collecting station of a paper making machine is supplied by the spraying devices of a single wetting unit, the surface of the web collects a large number of droplets whose penetration into the material of the web is slow. Consequently, and when the web is transported at a high speed, the moistened portion is likely to reach the collecting station prior to complete absorption of all droplets. This causes the aforediscussed spotting of convoluted paper. On the other hand, if the moisture content is increased in two or more stages or steps, and each battery or row of spraying devices is followed by a cylindrical member which promotes the distribution and penetration of atomized liquid into the material of the web, the absorption is complete before the respective portion of the web reaches the station CS. This is due in part to the provision of cylindrical members and in part to the fact that, when the moisture content is increased in several stages, the total quantity of liquid which is being discharged by the spraying devices of a wetting unit is relatively small so that the absorption of such small quantity of liquid can be completed before the respective portion of the web reaches the next-following wetting unit or the collecting station. Therefore, the appearance of the convoluted material is much more satisfactory than in machines wherein the web is wetted by a single battery of spraying devices. The spraying devices of a single battery must discharge substantial quantities of liquid per unit of time so that, even if the atomizing action of the spraying devices is highly satisfactory, small droplets which reach the adjacent side of the running web accumulate into large droplets or pools which cannot be absorbed in good time before the corresponding portions of the web reach the collecting station.

Another advantage of the improved wetting apparatus is that at least one of its wetting units can employ a cylindrical member (e.g., the cylinder 4) which is a component part of the paper making machine. This reduces the initial and maintenance cost as well as the space requirements of the wetting apparatus.

The placing of one or more wetting units immediately downstream of the drying unit (including the rollers 2 and 3 of FIG. 1) is desirable and advantageous because the drying of the web is completed not later than at the point where the web leaves the roller 3 and therefore, the liquid which is being supplied by the spraying devices of the foremost wetting unit or units has ample time to permeate the material of the web during transport to the station CS. If desired, the rate at which the foremost wetting unit 18 supplies liquid can be higher than the rate of liquid feed by the unit 22, and so forth.

The wetting unit 24 of FIG. 2 comprises in elongated carrier 20 which extends transversely of the respective portion of the path for the paper web 1 and serves as a support for a row of spraying devices 19. The devices 19 are mounted on discrete arms or brackets 27 which are secured to the carrier 20 (see FIG. 3). The carrier 20 further supports one end portion of an elongated air supplying pipe 28 which receives compressed air from a blower or pump 30 and contains a pressure regulating valve 31. The pipe 28 has a plurality of branches 29 each of which supplies compressed air to a discrete spraying device 19. The valve 31 can be regulated by a knob 69 on a control panel 35 (see FIG. 7) and the selected pressure is indicated by a pressure gauge 68. In the presently preferred embodiment, air in the pipe 28 is maintained at a pressure of 0.05–0.2 atmospheres superatmospheric pressure, most preferably at 0.06–0.12 atmospheres.

The carrier 20 is hollow (see FIG. 3) to form an elongated chamber 35 which contains portions of discrete conduits 33 serving to supply streams of water to the spraying devices 19. A portion of each conduit 33 further extends through a box or receptacle behind the control panel 34 of FIG. 7. The chamber 35 receives a heating coil 36 which prevents (or reduces the likelihood of)accumulation of droplets of condensate in or on the carrier 20. If the carrier 20 is mounted at a level above the path for the paper web 1 (see the wetting unit 22, 24 or 26 of FIG. 1), the dripping of condensate onto the paper web can be prevented by placing a preferably heated intercepting receptacle (not shown) between the carrier and the adjacent portion of the path for the web.

In FIG. 2, the carrier 20 extends transversely across the entire path for the paper web 1. However, it is equally possible to employ two discrete carriers each of which supports a set of spraying devices 19 and which extend, in cantilever fashion, from the two marginal portions toward the median portion of the moving web. Such construction of the wetting units is advisable when the moisture content of the median portion of the web is satifactory, i.e., when the wetting units are to increase only the moisture content of the marginal portions of the web.

The details of one of a spraying device 19 are shown in FIG. 4. This device comprises a body or housing 19*a* which supports two discrete water discharging nozzles 37 and 38. The axes of the nozzles 37, 38 make an acute angle and these nozzles are respectively surrounded by air discharging nozzles 38, 40 having conical orifices which taper toward the discharge ends of the nozzles 37, 38. The rear or inner portions of the nozzles 37, 38 are externally threaded and mesh with internally threaded portions of the housing 19*a*. The axial passages 41 of the nozzles 37, 38 communicate with discrete channels 42, 43 which are machined into the housing 19*a* and each of which is connected with a discrete conduit 33. It will be appreciated that each spraying device 19 may comprise a single water discharging nozzle and a single air discharging nozzle, or that the number of water- and air-discharging nozzles can be increased to three or more.

The housing 19*a* is further formed with an additional channel 44 which receives compressed air from the respective branch pipe 29 and supplies compressed air into a compartment 45 which is in communication with the orifices of both air discharging nozzles 39, 40. Instead of having a single compartment 45, the housing 19*a* may be provided with two discrete compartments, one for each of the nozzles 39, 40 and each receiving compressed air from the channel 44. The compartment 45 receives two twisting or swirling members 46 each of which serves to impart a circular movement to the current of air issuing from the respective nozzle 39, 40. The members 46 are axially movably mounted on the cylindrical median portions of the respective nozzles 37, 38 and are respectively surrounded by the cylindrical portions 47, 48 of the respective nozzles 39, 40. The nozzles 39, 40 are held in selected axial positions by nuts 49, 50. The nozzles 37, 39 define a first ring-shaped chamber 51 which receives a current of circultaing air from the helical path defined by the left-hand member 46 and portion 47, and the nozzles 38, 40 define a similar second chamber 52 which receives a current of circulating air from the helical path between the right-hand member 46 and the portion 48. The currents of air which leave the chambers 51, 52 form two hollow cones which surround the jets of water issuing from the orifices of the nozzles 37, 38 and effect a highly satisfactory atomization of such jets, i.e., each jet is converted into a fine spray 21 of minute droplets which impinge on the adjacent portion of the respective side of the moving web 1. The pressure of water issuing from the nozzles 37, 38 may be extremely low, for example, 20–200 millimeters water column. It has been found that the conical currents of air issuing from the chambers 51 and 52 actually suck or peel off extremely thin layers or strata from the slightly pressurized water jets and thereby effect a surprisingly satisfactory atomization of the liquid which is directed toward the moving web 1.

The conduit 33 receive water from a main supply conduit 54 (see FIG. 5) which contains a check valve 53, a first pressure regulating valve 55, a flow rate indication device 56, a flow rate monitoring gauge 57 with a rotor 58, an automatic pressure regulating valve 59, an accumulator 60, and a shutoff valve 61. The valve 59 is adjustable; however, once adjusted, it cooperates with the accumulator 60 to maintain the liquid in the conduits 33 at a preselected constant pressure within the aforementioned range. The shutoff valve 61 may be a conventional pneumatically operated valve, e.g., a valve which is controlled by a magnetic three-way pilot valve. The gauge 57 preferably constitutes a transducer which supplies electric signals for a digital indicator 72 and to a device 75 which records the quantities of conveyed liquid. When the gauge 57 transmits signals to the recording device 75, the signals are caused to pass through a suitable frequency modulator so that the recording device plots a curve which is indicative of the rate of liquid flow through the main supply pipe 54. For example, the frequency modulator may constitute a circuit which receives at its input a periodic signal having a frequency which varies in direct correspondence with the measured variable (flow rate) and which generates at its output a steady-magnitude D.C. signal (e.g., D.C. current) having a magnitude which is directly indicative of (e.g., directly proportional to) the measured variable.

The aforementioned conduits 33 branch from the main supply conduit 54 and each thereof contains a discrete shutoff valve 62, adjustable flow restrictor or throttle 63 with an actuating knob 63*a*, and a flow rate indicating device 64. One of the devices 64 (which may but need not be identical with the device 56 in the main supply conduit 54) is shown in FIG. 6. It comprises a transparent or translucent upright tube 65 whose diameter decrases in a downward direction and which contains a weight 66. At least the lower portion of the weight 66 constitutes or resembles a cone whose taper is more pronounced than that of the tube 65. The tube 65 has a circular cross-sectional outline, the same as the weight 66. The stream of water which enters a conduit 33 through the open shutoff valve 62 flows upwardly through the tube 65 of the indicating device 64 and causes the weight 66 to float whereby the level or locus of the weight indicates the rate of liquid flow. The width of the annular throttling orifice between the cylindrical or nearly cylindrical upper end portion of the weight 66 and the internal surface of the tube 65 increases when the weight rises, and decreases when the weight descends toward the respective shutoff valve 62. The indicating devices 64 are preferably placed one next to the other (see FIG. 5) and are observable on the control panel 34 (see FIG.7) so that the weights 66 form a curve 67 (FIG. 7) which is indicative of the rate of liquid flow to the respective nozzles 37, 38. The curve 67 thus indicates the quantities of liquid which are being supplied to the respective strip-shaped portions of the moving web 1. This curve is preferably selected (by manipulating the knobs 63*a*) in such a way that it is complementary to the "drying profile" of the web 1. Thus, and as shown in FIG. 5 or 7, the outermost spraying devices 19 discharge more liquid than the centrally located devices 19 because the moisture content of the marginal portions of the web 1 is normally less than the moisture content of the median portion. The mositure content of different strip-shaped portions of the web 1 can be determined by a capacitive or other measurement in a manner not forming part of the present invention.

The inlet of the main supply pipe 54 is connected with a pump 154 or the like which supplies water at a requisite pressure (e.g., 1–2 atmospheres superatmospheric pressure), and such pressure is reduced (if necessary) by the valve 55. The automatic pressure regulating valve 59 cooperates with the accumulator 60 to insure that the pressure at the inlet of each conduit 33 is within a desired range (e.g., 0.2–2.0 atmospheres superatmospheric pressure). The flow restrictors 63 further reduce the water pressure to a range of 20–200 millimeters water column. As stated above, the configuration of the curve 67 formed by the weights 66 depends on the setting of the flow restrictors 63. The purpose of the valve 59 is to insure that the rate of water flow through one or more conduits 33 is not influenced by the rate of wate flow through the other conduits 33, e.g., that the increased rate of flow through the leftmost and rightmost conduits 33 of FIG. 5 does not entail an undue reduction of the rate of water flow through the median conduits 33.

The box behind the control panel 34 of FIG. 7 contains all control elements of the apparatus. These include the aforementioned knob 69 and gauge 68, the indicating devices 56 and 64, the knobs 63*a* for adjustment of the flow restrictors 63, a gauge 70 which indicates the pressure of water in the inlet of the main supply pipe 54, a further gauge 71 which indicates the water pressure in conduit 54 downstream of the valve 59, the digital indicator 72 and recording device 75 which are controlled by the gauge 57, an indicator 73 of the quantity of liquid which is being supplied to the spraying devices 19 per unit of time, a rated value selector 74 for the water pressure in pipe 54 downstream of the valve 59, and a set of signal lamps and actuating elements 76. The lamps indicate the positions of various valves and the on- or off- condition of the respective wetting unit. The actuating elements can start or arrest the blower 30 for compressed air, the pump 154 and other components of the wetting unit. The control panel 34 further carries a knob 77 for adjustment of the valve 55.

The apparatus may comprise a discrete control panel 34 for each wetting unit. However, it is equally within the purview of the invention to provide a single control panel for all wetting units or to provide two or more control panels, each for two or more wetting units.

By placing at least one wetting unit (18, 22 and/or 23) ahead of the first calendering unit 7, one insures that the web which is conveyed through the first calendering unit does not ccomprise any dry portions. This is desirable and advantageous because the wear upon the calendering rolls is less prounounced than in a machine wherein the calendering rolls engage a dry web.

A device which can measure and indicate the moisture content in neighboring portions of the web, as considered at right angles to the direction of travel of the web is sold under the name "Measurex Computer-Integrated Control System" by Measurex Corporation, Cupertino, Cal.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters patent is set forth in the appended claims:

1. Apparatus for wetting a continuous web of at least partially dried paper which is moved in a paper making machine along a predetermined path and in a predetermed direction toward a collecting station where the web is converted into a roll, comprising a plurality of wetting units including a first wetting unit adjacent to a first portion and a second wetting unit adjacent to a second portion of said path, said second portion of said path being located downstream of said first portion, as considered in said direction, and each of said units including a plurality of spraying devices forming at least one row extending substantially transversely of the respective portion of said path, each of said devices having means for directing at least one spray of atomized liquid against one side of the moving web and each wetting unit further comprising a substantially cylindrical member located downstream of the respective spraying devices, as considered in said direction, and engaging the freshly moistened side of the web to distribute the liquid in the material of the web.

2. Apparatus as defined in claim 1, wherein at least one of said cylindrical members constitutes a rotary component of the paper making machine and is arranged to move and/or guide the web in said path.

3. Apparatus as defined in claim 1, wherein the cylindrical member of said first wetting unit constitutes a cooling cylinder of the paper making machine.

4. Apparatus as defined in claim 1, wherein the spraying devices and cylindrical members of said first and second wetting units are located at the opposite sides of said path.

5. Apparatus as defined in claim 1, wherein each of said spraying devices comprises at least one first nozzle having a first orifice, means for supplying to said nozzle a stream of liquid at a first pressure, a second nozzle surrounding said first nozzle and having an annular second orifice surrounding said first orifice, and means for supplying to said second nozzle compressed air at a higher second pressure whereby the air issuing from said second orifice atomizes the liquid issuing from said first orifice.

6. Apparatus as defined in claim 5, wherein said second pressure is between 0.05–0.2 atmospheres superatmospheric pressure.

7. Apparatus as defined in claim 5, wherein said second pressure is between 0.06–0.12 atmospheres superatmospheric pressure.

8. Apparatus as defined in claim 5, wherein said second orifice tapers in the direction of air flow through said second nozzle.

9. Apparatus as defined in claim 5, further comprising means for circulating air in the orifice of said second nozzle.

10. Apparatus as defined in claim 1, wherein each of said wetting units further comprises a plurality of conduits for supplying liquid to said spraying devices and adjustable flow restrictor means in each of said conduits.

11. Apparatus as defined in claim 10, further comprising means for indicating the rate of liquid flow through each of said conduits.

12. Apparatus as defined in claim 11, wherein each of said indicating means comprises an upright tube consisting at least in part of light-transmitting material and defining a passage whose diameter increases in a direction from the lower toward the upper end thereof, a weight received with clearance in said passage, and means for admitting liquid into the lower end of said passage so that the liquid which flows upwardly through said pipe maintains said weight at a level which is indicative of the rate of liquid flow in the respective conduit.

13. Apparatus as defined in claim 12, wherein each of said weights includes a downwardly tapering conical portion defining with the respective tube an annualar orifice whose width decreases in a direction from the lower end toward the upper end of the respective tube.

14. Apparatus as defined in claim 12, wherein said tubes are adjacent to each other.

15. Apparatus as defined in claim 14, wherein said flow restrictor means are installed in said conduits below the respective indicating means.

16. Apparatus as defined in claim 10, further comprising a main liquid supplying conduit connected with the inlets of said first mentioned conduits and means for maintaining the pressure of liquid at said inlets within a predetermined range.

17. Apparatus as defined in claim 16, wherein said liquid pressure maintaining means comprises an adjustable pressure regulating valve and an accumulator.

18. Apparatus as defined in claim 16, further comprising means for indicating the rate of liquid flow through said main liquid supplying conduit.

19. Apparatus as defined in claim 1, wherein each of said wetting units further comprises means for supplying liquid and air to each of said spraying devices and further comprising a control panel for at least one of said wetting units and means on said panel for adjusting, recording and/or indicating the rate of liquid and air flow to the spraying devices of said one wetting unit.

20. Apparatus as defined in claim 1, further comprising means for calendering the web in a third portion of said path, at least one of said first and second portions of said path being located upstream of said third portion.

21. A method of treating a continuous web of paper in a paper making machine, particularly a web of newspring paper, comprising the steps of drying the web; transporting the dried web along a predetermined path and in a predetermined direction toward a station where the web is converted into a roll; and increasing the moisture content of the web in a plurality of successive stages in a plurality of different portions of said path, each of said stages comprising spraying atomized liquid onto one side of the moving web in the respective portion of said path and thereupon mechanically distributing the freshly sprayed liquid at the respective side of the web to promote the penetration of liquid into the material of the web.

22. A method as defined in claim 21 for treating continuous web wherein different strip-shaped portions of the dried web contain different percentages of moisture, further comprising the step of measuring the moisture content of said strip-shaped portions of the web, said step of increasing the moisture content including spraying said atomized liquid onto the respective side of the moving web during at least one of said stages at such a rate that the strip-shaped portions having a higher moisture content receive smaller quantities and the strip-shaped portions having a lower moisture content receive greater quantities of atomized liquid.

23. A method as defined in claim 21, wherein said path is elongated and at least two stages of said step of increasing the moisture content are completed in those portions of said path which are remote from said station.

24. A method as defined in claim 21, wherein said liquid is sprayed onto the first side of the moving web during one of said stages and onto the second side of the moving web during another of said stages.

* * * * *